US007444782B2

(12) United States Patent
Crowell

(10) Patent No.: US 7,444,782 B2
(45) Date of Patent: Nov. 4, 2008

(54) BUILDING SYSTEM, STRUCTURE AND METHOD

(76) Inventor: James H. Crowell, 4629 SW. Lakeview Blvd., Lake Oswego, OR (US) 97035

( * ) Notice: Subject to any disclaimer, the term of this patent is extended or adjusted under 35 U.S.C. 154(b) by 0 days.

(21) Appl. No.: 11/523,752

(22) Filed: Sep. 18, 2006

(65) Prior Publication Data

US 2007/0193144 A1 Aug. 23, 2007

Related U.S. Application Data

(63) Continuation of application No. 10/096,358, filed on Mar. 11, 2002, now abandoned.

(60) Provisional application No. 60/275,079, filed on Mar. 11, 2001.

(51) Int. Cl.
*E04B 7/04* (2006.01)

(52) U.S. Cl. ..... 52/93.1; 52/93.2; 52/264; 52/592.6; 52/763

(58) Field of Classification Search ..... 52/763, 52/764, 91.1, 263, 264, 93.1, 93.2, 292, 592.6, 52/284, 202.1, 59, 573.1, 92.1, 92.2, 293.3, 52/295, 589.1, 590.2, 592.1
See application file for complete search history.

(56) References Cited

U.S. PATENT DOCUMENTS

| | | | | | |
|---|---|---|---|---|---|
| 239,669 | A * | 4/1881 | Peck | 52/780 |
| 1,652,612 | A * | 12/1927 | Daniels | 403/364 |
| 1,657,441 | A * | 1/1928 | Huovinen | 52/293.2 |
| 1,717,546 | A * | 6/1929 | Bemis | 52/259 |
| 2,226,332 | A * | 12/1940 | Bacci | 52/578 |
| 3,452,498 | A * | 7/1969 | Kinsey | 52/262 |
| 3,736,709 | A * | 6/1973 | Koch et al. | 52/97 |
| 3,828,502 | A * | 8/1974 | Carlsson | 52/309.11 |
| 4,147,001 | A * | 4/1979 | Oliver | 52/284 |
| 4,688,362 | A * | 8/1987 | Pedersen et al. | 52/223.7 |
| 4,726,567 | A * | 2/1988 | Greenberg | 256/19 |
| 4,739,597 | A * | 4/1988 | Voegeli et al. | 52/223.7 |
| 4,823,528 | A * | 4/1989 | Faw | 52/233 |
| 4,850,170 | A * | 7/1989 | Douglas et al. | 52/427 |
| 5,138,808 | A * | 8/1992 | Bengtson et al. | 52/204.2 |
| 5,236,625 | A * | 8/1993 | Bardo et al. | 261/24 |
| 5,245,803 | A * | 9/1993 | Haag | 52/90.1 |
| 5,274,974 | A * | 1/1994 | Haag | 52/300 |
| 5,293,725 | A * | 3/1994 | Matticks et al. | 52/271 |
| 5,575,127 | A * | 11/1996 | O'Neal | 52/520 |
| 5,608,999 | A * | 3/1997 | McNamara | 52/275 |
| 6,105,326 | A * | 8/2000 | Schmidt-Lutz | 52/437 |
| 6,161,349 | A * | 12/2000 | Carr | 52/270 |
| 6,189,269 | B1 * | 2/2001 | De Zen | 52/220.5 |
| 7,243,464 | B1 * | 7/2007 | Crowell | 52/93.2 |
| 7,246,469 | B2 * | 7/2007 | Back et al. | 52/90.1 |

* cited by examiner

*Primary Examiner*—Daniel P. Stodola
*Assistant Examiner*—Nahid Amiri
(74) *Attorney, Agent, or Firm*—Kolisch Hartwell, P.C.

(57) ABSTRACT

A modular building system wherein extruded, elongate, plastic building components can quickly, and with no special tools or skills, be snapped and slidably fit together to form a wide variety of different building structures. The proposed system produces frameless buildings wherein surface closure structures, like walls, windows, doors and roof panels are bound into stability through building-wrapping banding structures that include upright, perimeter stabilizer bars, roof trusses, and in most instances, the underlying ground. Within a finished building, the closure structures effectively float and react with relative motion responses to different applied building loads.

17 Claims, 7 Drawing Sheets

BUILDING SYSTEM, STRUCTURE AND METHOD

CROSS-REFERENCE TO RELATED APPLICATION

This is a continuation application of Ser. No. 10/096,358 filed Mar. 11, 2002, now abandoned, which claims priority to U.S. Provisional Application Ser. No. 60/275,079 filed Mar. 11, 2001 titled "All Encompassing 'Whole System' Alternative Methods of Light to Medium Construction with Optional Rainwater Reclamation System"all of which are incorporated in their entirety by reference.

BACKGROUND AND SUMMARY OF THE INVENTION

This invention pertains to a modular building system, structure, and associated methodology. In particular, it relates to such a system, structure and methodology that feature an extremely simple, cost-effective, versatile, robust and intuitive field-assembly organization of interrelated components that can be interassembled quickly on a job site to create a large variety of different kinds of essentially frameless buildings, including residences, schools, warehouses, multi-story structures, and other kinds of buildings. Components proposed by the present invention are readily combinable in a host of different architecturally unique, personal and interesting ways, and perform with one another in a finished structure with some remarkable load-handling performance, and stable endurance, capabilities.

Throughout most of a building of any category constructed in accordance with this invention, interlocking components are employed which are formed preferably from extruded (or pultruded) plastic material (hereinafter only referred to as extruded material), which components can even be produced (extruded and trimmed to appropriate sizes) strictly and easily on a job site itself, if so desired. From a relatively small population of different extrusion dies, a rich inventory of multipurpose components that are combinable (joinable) without there being any requirement for especially skilled labor, or for any exotic inventory of tools, are proposed and made possible by the invention. These components, when brought together, slidably and snappingly produce functionally unique building structures that are characterized by floating, relative-motion, closure structures (wall elements, doors, windows and roofing panels) that respond admirably by yielding motion to different kinds of loads and climate conditions (wind and storms) typically experienced by buildings.

The building system, structure and methodology of the instant invention present a number of unique facets and new advantages in the art of building construction, and some of the new areas of contribution of this invention rest at least in part upon a functional analogy to long-proven and admired hoop-and-stave structure in a barrel. More specifically, proposed according to the present invention is a construction wherein what are referred to herein as plural banding structures essentially fully, or nearly so, and from one point of view, circumsurround the structural elements forming the space occupied by a finished building, with closure structures, such as roof panels, wall elements, windows, doors, etc., supported as floating, elements that are held together and stabilized within the banding structures.

Featured, for example, according to the invention, are wall structures that are formed, at least in part, from elongate, generally horizontal, vertically stacked, hollow, extruded, plastic beams which are designed and supported so as to operate as independent elements during various building loading conditions. These beams meet and engage one another through sliding interfaces between vertically next-adjacent beams, which interfaces allow the beams to bend independently, and thereby to adjust and position themselves longitudinally relative to one another. Opposite ends of these beams, while constrained against any gross motions, are nevertheless permitted slight migrations relative to one another to allow for such independent bending and sliding interfacial motion.

A similar kind of arrangement is afforded for roof-structure panels that are held within the mentioned banding structures in such a fashion that they can also move relative to one another when appropriate to deal with various building loading conditions, such as those associated with high wind storms, heavy snow loading, etc.

Continuing with a somewhat fuller, overall, preliminary discussion regarding this invention, a building which is made in accordance with the invention includes one of several different types of preferred foundation structures wherein perimeter members (in each case) are formed from defined-cross section extruded plastic material, such as a polyvinyl chloride (PVC) material of any appropriate choosing.

One of these foundation types is especially suitable for subground-type supporting of a single-outside-wall-type building structure, such as a residence. This foundation structure, as viewed in longitudinal cross section, is characterized by a kind of flattened V-shaped configuration. The superstructure support platform, so-to-speak, in this foundation lies substantially at ground-surface level.

Another proposed foundation type is particularly suitable for ground-surface-level support of a double-outside-wall type building structure, such as a warehouse. This foundation structure has a somewhat flattened Z-shaped configuration as viewed in longitudinal cross section.

A third type of proposed foundation is especially suited for the above-ground foundationing of the superstructure in a building, such as the residence mentioned above. This foundation structure, as viewed in longitudinal cross section, has a rectangular configuration.

Where, for any one of a number of reasons, concrete is poured as a part of foundation (or other) building construction, the extruded components of the present invention act as the local forms for such concrete, and since these components are in ultimately to become part of the finished structure, traditional "form removal" is not a required activity.

With respect to all of these foundation types, clusters of elongate, upright stabilizer bars rise therefrom to provide horizontal stabilization of overhead wall structures. The upper ends of these bars also act to anchor overhead roof structure directly to the foundation. In the specific cases of the two foundation types which support superstructure at ground-surface level, the associated stabilizer bars extend downwardly through the foundation to anchor into the ground. In the cases where the stabilizer bars are driven into the ground, the ground itself plays a role in forming what were referred to above as banding structures.

In the construction of a building according to the invention, and with the foundation and stabilizer bars in place, wall beams are slid downwardly into place over the stabilizer bars, and are snapped together to form vertical stacks through tongue-and-groove, male/female nesting structures. Snapped-together nesting structures modestly lock vertically next-adjacent beams against vertical separation, while at the same time furnishing sliding interfaces between adjacent beams. At corners in a building, and at any other location where the vertically adjacent ends of such beams are located, these ends are received freely within reception channels that are formed in vertically-extending trim pieces that define such building corners, or the sides of doors, windows, etc. The wall beams are hollow, and possess inner and outer, spaced, parallel faces, between which the stabilizer bars usually extend. If desired, exposed beam surfaces may be pre-profiled, colored, textured, etc. to provide an immediate, post-assembly finished look.

This arrangement, appropriately toleranced between adjacent components, uniquely permits the beams in a wall structure to slide relative to one another longitudinally to deal with various kinds of loads that are delivered to buildings, thus to allow each beam to act somewhat as an independent beam element.

With wall beams in place, windows and doors, which are perimetrally bounded by extruded trim structure, are also slid into place. The emerging building is now ready for roof structure. Several specifically different kinds of roof structures are proposed by the present invention, and all of these are illustrated and described hereinbelow.

One type of roof structure which might typically be employed in a single-outside-walled building, such as a residence, includes angularly intersecting, elongate, linear rafters which rise from spaced, generally parallel wall structures toward an elevated ridge. These rafters, once in place, are poised to receive slidably introduced roof panels which may take different forms. One such form disclosed herein is solid and light-opaque in nature. Another is built with translucency or transparency. All, once in place, can shift slightly relative to one another to accommodate various building loading conditions.

The rafters in such roof structure cooperate with the stabilizer bars to which they are effectively anchored, to form a completion over the upper reaches of a building, of the earlier-mentioned banding structures. Anchoring of the roof structure to the stabilizer bars, effectively anchors the roof structure to the foundation and the ground. Vertical downward loads that are borne by a roof structure in accordance with the present invention create compressive loads downwardly through the wall beams to the foundation and the ground. Vertical upwardly directed loads on a roof structure, such as the very serious kinds of loads experienced during high wind and storm conditions, are uniquely borne in tension through the stabilizer bars, which deliver load directly from the roof structure to the foundation.

Another proposed roof structure is very much like the first one just outlined above, except that the rafter structure employed does not include a ridge-line intersection angle. Rather, it features, preferably, elongate, continuous arched rafters which are retained in an appropriate arched condition via compression attachments provided adjacent the rafters' respective opposite ends near the tops of spaced walls.

A third roof structure type differs from the one just mentioned above by featuring elongate, continuous arched rafters which are held in arched conditions by elongate tension lines coupled to, and extending between, the rafters' opposite ends.

A fourth type of roof structure proposed by the present invention is an arched, cross-cable trussed structure which has special utility in connection with spanning broad areas between widely spaced wall structures.

All of the many, newly contributed aspects of the system, structure and methodology of the present invention will become more fully apparent as the detailed description which now follows below is read in conjunction with the accompanying drawings.

DESCRIPTION OF THE DRAWINGS

FIG. 16A is an exploded view, and FIG. 17, a cross section taken generally along the line 17-17 in FIG. 16A.

DETAILED DESCRIPTION OF, AND BEST MODE FOR CARRYING OUT, THE INVENTION

Figure 1:
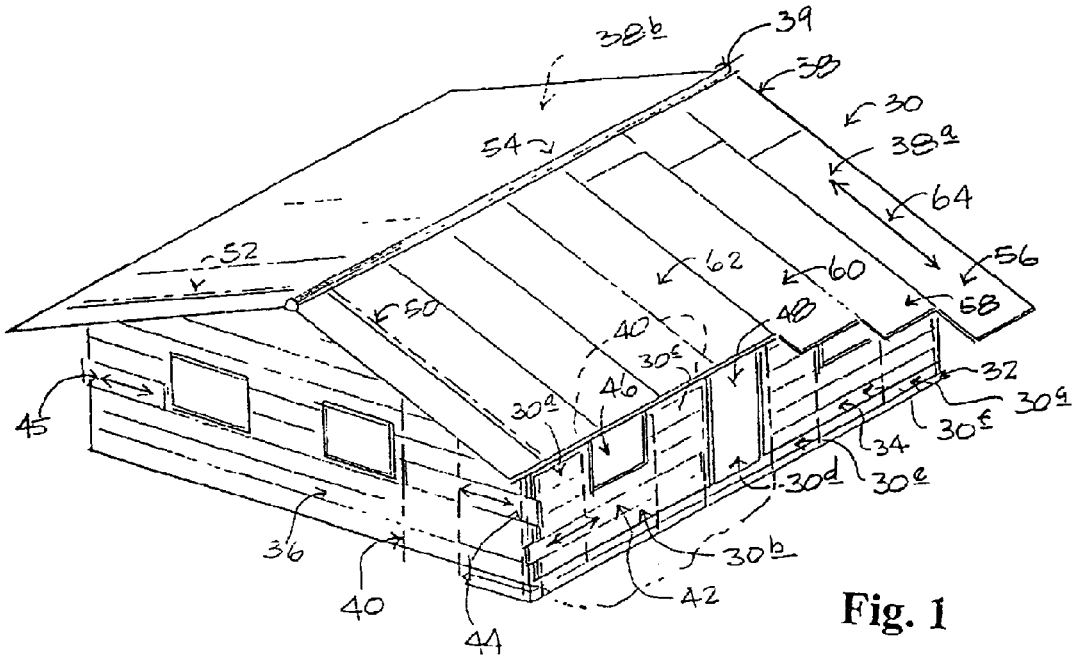
FIG. 1 is a fragmentary, isometric, simplified diagram of a residence, or residence structure, which has been constructed in accordance with the present invention.

Turning now to the drawings, and referring first of all to FIG. 1, indicated generally at 30 is a building structure constructed in accordance with the present invention. For the purpose of illustration herein, building structure 30 takes the form generally of a single-story residence, illustrated only in very simplified form in this figure. Residence 30 includes one of the two previously-mentioned forms of below-ground foundation structure 32 constructed in accordance with the invention. Seated on top of foundation 32, and rising therefrom, are single-layer, outside wall structures, or walls, such as the two shown generally at 34, 36. These two walls are disposed generally orthogonally with respect to one another, with wall 34 being one of the two outside rectangular-perimeter walls, and wall 36 being one of the two gabled walls. Seated on top of these walls is a ridged, roof structure 38 which includes, generally speaking, two broad expanses 38*a*, 38*b*, separated angularly by a ridge structure 39.

Shown generally by dashed lines, such as the several lines appearing at 40, are groups, or clusters, of upright, elongate stabilizer bars, the specific structures of which will be described more fully shortly. In general terms, these stabilizer bars, which are also referred to herein as stabilizer or stabilizing structure, as load-transmitting bars, and as tension elements, extend through foundation 32 and into the ground. The stabilizer bars rise from the foundation, according to an important feature of the invention, to provide anchoring points directly for roof structure 38. These stabilizer bars, in addition to providing direct anchoring to the foundation and ground for roof structure 38, also act to stabilize generally the vertical and lateral positions of beam elements, or beams, soon to be more fully described, which make up much of the exterior walls in residence 30.

Each of these walls is formed from a plurality of different elements which include plural, elongate (different length) hollow beam elements, or beams, such as the beams shown generally at 42, 44, 45 in walls 34, 36, respectively. Also included in the walls, such as in wall 34, in association with these beams, are window and door structures, such as those shown generally at 46, 48, respectively, in FIG. 1. Ignoring for a moment the obvious fact that the window and door structures "interrupt" the stretches of the beams along the length of wall 34, and as will become apparent, the walls are assembled collectively from components in such a manner that each elongate, horizontal beam which forms part of wall is permitted a certain amount of longitudinal relative motion with respect to other beams in the same wall. Double-ended, linear arrows which appear on previously-mentioned beams 42, 44, 45 represent this relative motion capability.

The beams are stacked one upon another, engaging through what are referred to herein as co-contacting slide, or sliding, surfaces, or interfaces formed generally as male/female, tongue-and-groove substructures, also referred to herein as nesting structures. These sliding interfaces accommodate the relative motion behavior just mentioned. As will also become more fully apparent from description which is still to follow, while longitudinal relative motion is permitted the wall beams, the actual amount of such motion which is allowed is relatively small, but indeed large enough to accommodate loading and other conditions that tend to stress a building structure. One way of thinking about this relative motion capability offered by the structure of the present invention is that each wall beam is permitted to respond to loading very much as an independent flexing and bending beam element, with such independent flexing and bending leading to the type of relative motion mentioned. The previously-mentioned and generally pictured stabilizer bars, while stabilizing the wall and the beams therein, nonetheless allow the relative-motion response capability in the beams, which capability is an important behavioral response of a building structure made in accordance with this invention.

While different specific allowed relative motions can be chosen to suit different building applications, in residence 30, each wall beam is permitted longitudinal relative motion of up to about ¼-inches. As will become apparent, in the regions adjacent opposite ends of each beam, each end is received in channel-like structure furnished in an appropriate upright trim piece, and it is within this channel structure that the clearance for such motion is provided.

Within residence 30, and generally associated with the several upright clusters 40 of stabilizer bars that are distributed along each wall, and forming portions of roof structure 38, are rafters, or rafter structures, like those shown generally at 50, 52. Also included in roof structure 38, as pictured in FIG. 1, are plural, elongate panels, such as panels 56, 58, 60, 62, which are shown on the near, right side of the roof structure in FIG. 1. As will become more fully apparent, each of these panels resides effectively slidably between a pair of rafters. Just as was described for the wall beams, the roof panels are also permitted a certain amount of relative motion, generally as indicated by double-ended linear arrow 64 in FIG. 1. This motion is permitted independently of motions also permitted to the other panels which make up the overall roof structure. And as was true with respect to relative motions afforded the wall beams, the roof panels, while permitted a certain amount of relative motion to accommodate loading and stressing of the roof structure, are constrained enough so that the overall building structure is well stabilized.

In FIG. 1, the moved positions which are shown for wall beams and roof panels are highly exaggerated simply to point out and emphasize the important relative-motion quality of a building structure made in accordance with the invention.

Figure 3:
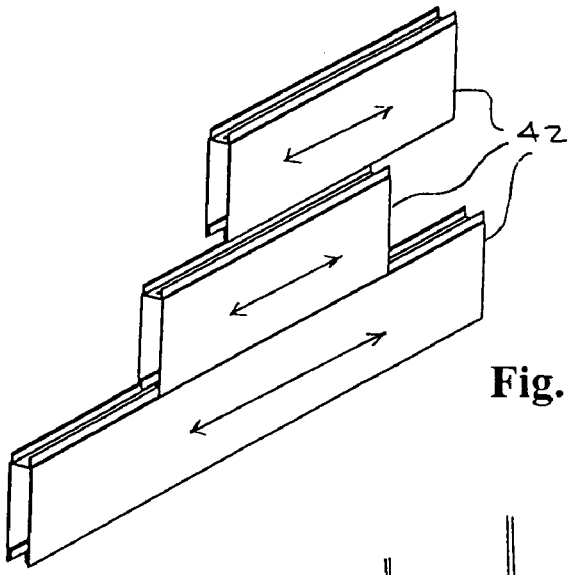
FIG. 3 is an isometric, isolated and fragmented view of several elongate, slidably interengaged wall beams which are present in the residence of FIG. 1, and which are constructed in accordance with the present invention.
Figure 4:
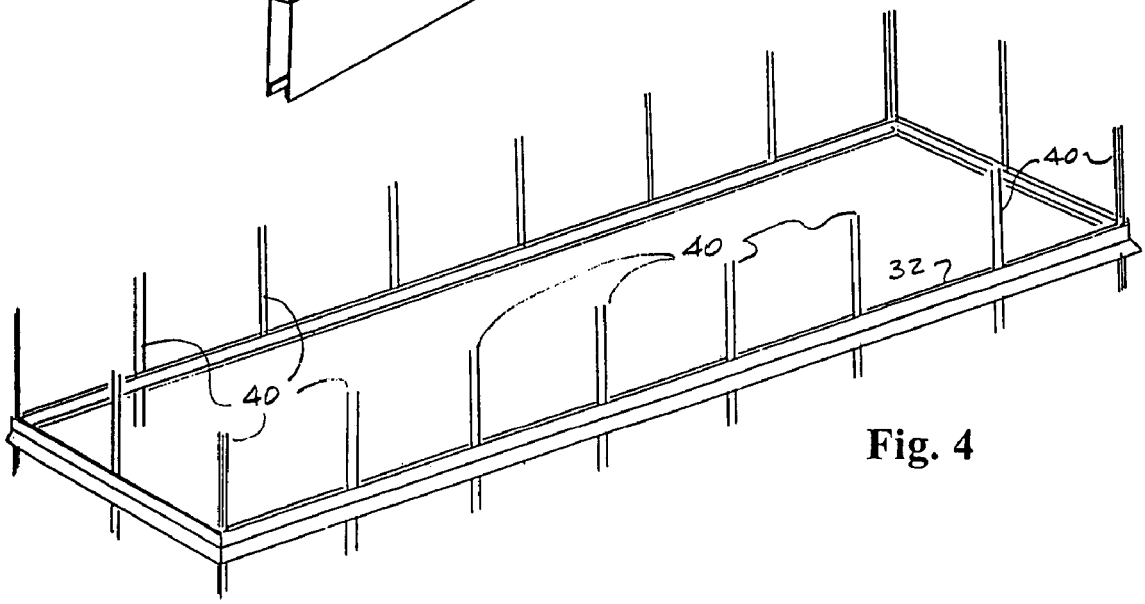
FIG. 4 is a simplified fragmentary, and somewhat stick-figure view isolating and showing the below-ground foundation, and the plural clusters of upright, elongate stabilizer bars, which are employed in the residence of FIG. 1.
Figure 5:
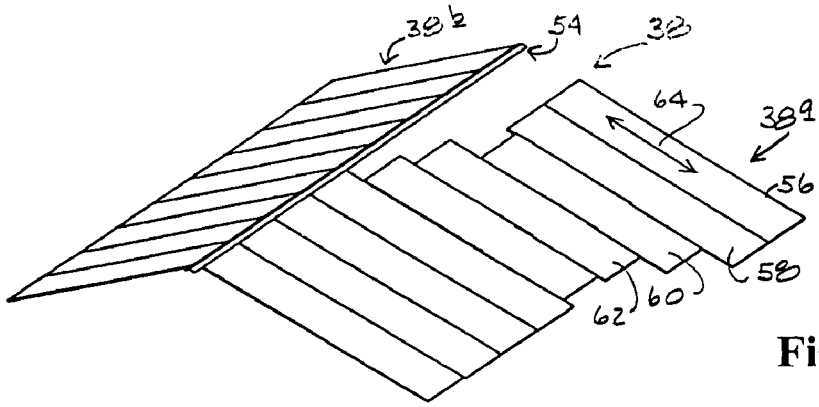
FIG. 5—a view which has somewhat the character of FIG. 3—shows, in isometric view, slidably supported panels that form part of the roof structure in the residence of FIG. 1.

FIGS. 3, 4, and 5 (second plate of drawings) help further to illustrate generally the respective structural organizations, and relative motions (exaggerated) discussed so far above. In FIG. 3, for example, conditions of the wall beams can clearly be seen. Also, here one can generally see the hollow natures of these beams, as well as the male/female, tongue-and-groove characteristics of the beam nesting structures. Hollowness in the beams furnishes, among other things, space for the placement of insulation, and runs for electrical and plumbing structure.

FIG. 4 shows a bit more fully the various clusters of upright elongate stabilizer bars. As can be seen in this figure, and as will shortly be more fully described, the stabilizer bars are organized into clusters of (a) three bars adjacent the corners of residence 30, and (b), intermediate the corners, pairs of such bars. More will be said about these organizations below.

Before turning further attention now to details of construction of various building components in residence 30, it should be noted again that an important feature of residence 30 is that most of its components are formed, in accordance with this invention, of extruded plastic material. These components have specific configurations and forms which allow for highly intuitive, and very simple, snap, slide and fit-together construction of an entire building on a job site, with there being little requirement for skilled labor or special tools. The detailed description which will follow now with respect to certain specific components will make this characteristic of building structure as proposed by the present invention very apparent.

Figure 2A:
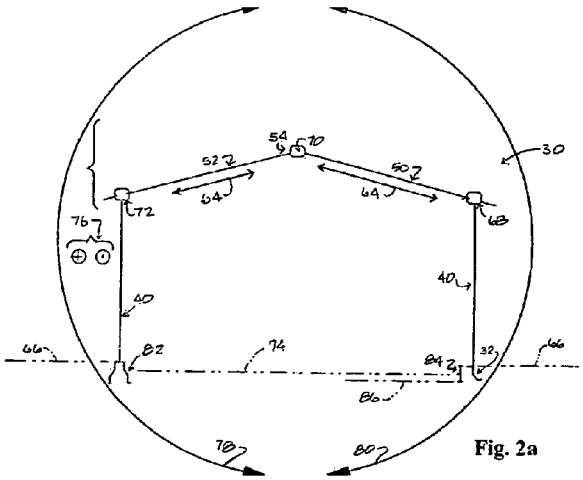
FIG. 2*a* is a schematic, stick-figure drawing, taken as if from one end, such as the near gabled end, of the residence of FIG. 1, generally showing the several building components which act collaboratively as banding structure, or structures, in this residence.
Figure 2B:
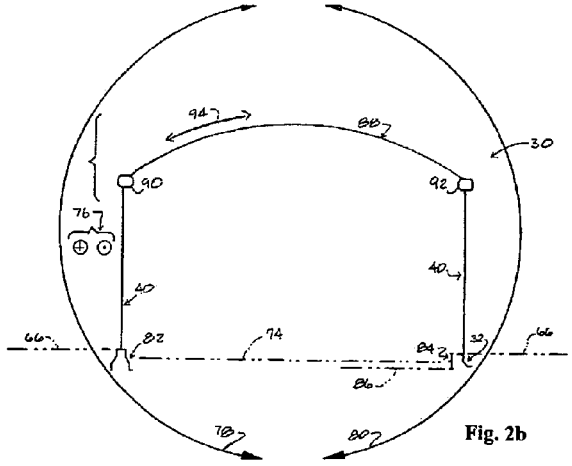
FIG. 2*b* is a schematic, stick-figure drawing, taken as if from one end, such as the near gabled end, of the residence of FIG. 1, generally showing the several building components which act collaboratively as banding structure, or structures, in this residence.

Accordingly, directing attention now to FIGS. 2*a-b* (first plate of drawings), foundation 32 is made up of elongate extruded plastic components which have a kind of flattened V-shaped configuration, as can be seen on the right lower side of FIGS. 2*a-b*. The upper support surface of this foundation essentially sits at ground level which, in FIGS. 2*a-b* at least with respect to foundation 32, is represented by dash-triple-dot line 66.

Rising upwardly from foundation 32, at the right side of FIGS. 2*a-b*, is stabilizer bar structure 40. At the upper end of bar structure 40 is a small block 68 which represents a load-transmitting connection to the right end of previously-mentioned rafter structure 50. The left end of structure 50 joins with the right end of previously-mentioned rafter structure 52 through a connection shown at 70 which exists at the angular ridge 54 previously mentioned in residence 30. The left end of rafter structure 52 is connected at 72 for load transmission downwardly through the foundation and into the ground through another stabilizer bar structure which is also designated in FIGS. 2*a-b*with reference numeral 40.

Within residence 30, foundation 32 is essentially cross-sectionally the same at all locations. However, within FIGS. 2*a-b*, the left side of the schematic building pictured here is illustrated with another form of foundation which will be discussed shortly. Ignoring for the moment that a different specific foundation structure is represented at the lower left corner of FIGS. 2*a-b*, and assuming for a moment that the same foundation structure 32 were there represented, a connection with and through the underlying ground is established from the lower ends of the stabilizer bars through foundation 32, and then through ground structure which bridges between opposite sides of the foundation components. Such bridging ground structure is represented by dash-double-dot line 74 in FIGS. 2*a-b*.

One can thus see on looking at FIGS. 2*a-b*that what has been referred to earlier herein as a banding structure effectively exists, and can be seen in the plane of FIGS. 2*a-b*. This banding structure includes stabilizer bar structure 40, rafter structures 50, 52, load-bearing and transmitting connections 68, 70, 72, foundation structure 32, and bridging ground structure 74. This representative banding structure which appears in the plane of FIGS. 2*a-b*will be seen, on referring back to FIG. 1, to be repeated essentially through the length of building structure 30 as such is measured along a line following ridge structure 54. And, as was mentioned earlier, it is within this organizing and stabilizing banding structure that the closure skin structure of the building structure, namely the roof panels, and the wall, window and door structures, are afforded a certain amount of limited, floating, relative-motion action. The two large double-ended curved arrows shown at 78, 80 in FIGS. 2*a-b*emphasize the circumsurrounding, or nearly so, hoop-like arrangement which has been referred to herein as banding structure.

In FIG. 2*a*, appearing near the upper left-side of the figure, is a repositioned version of previously-mentioned, double-ended straight arrow 64 which represents the principal direction of modest relative motion that is permitted to panels that make up the roof structure. One can see on comparing FIGS. 1 and 2*a*, that this relative motion in roof panels takes place along a line, or lines, which lie in the plane of FIG. 2*a*—a vertical plane. These lines are inclined relative to the horizontal, as dictated by the slope of the roof structure.

Pointed to at the left side in FIGS. 2*a-b*, generally by a curved arrow 76, are two circled symbols which reflect vector directions, or vectors, into and out of the plane FIGS. 2*a-b*. These vectors represent the reverse directions of relative motion permitted to the wall beams that make up those opposite, rectangular sides of building structure 30 which extend normally into the plane of FIGS. 2*a-b*. In other words, wall beams are permitted relative motion toward and away from the viewer in FIGS. 2*a-b*. This motion, one will see, takes place along a line, or lines, which are normal to the plane of FIGS. *a-b*, and which can be thought of as occurring in a vertical plane that is normal to the plane of FIGS. 2*a-b* . One will note further, thus, that the planes of relative motion permitted the roof panels, and that the plane (or planes) of relative motion permitted the wall beams, intersect one another along essentially upright gravity lines.

Completing a description of what is shown very schematically in FIGS. 2*a-b*, and with specific reference now made to certain alternative forms of foundation and roof structure proposed according to different modifications of the present invention, the foundation structure which appears at the lower left side of FIGS. 2*a-b* , and which is pointed to by reference numeral 82, is quite similar in construction to foundation structure 32. Structure 82 includes confronting pairs of flattened Z-shaped components. As will be more fully explained later, foundation 82 is most relevantly used with respect to larger building structures of the type which include double, rather than single, outside wall construction. Foundation 82 sits vertically, with respect to the ground, in essentially the same manner as does foundation 32.

Illustrated generally at 84 at the lower right side of FIGS. 2*a-b* is an alternative above-ground foundation which is employed according to another modification of the invention. Details of this foundation will be discussed later herein, but one can see in FIGS. 2*a-b* that foundation 84 is one that is designed to sit above the ground surface, such ground surface being represented by dash-double-dot line 86 in FIGS. 2*a-b*.

Curving overhead the elements so far described in FIG. 2*b* is an alternative, arched, broad-expanse roof structure 88 which is uniquely offered by the present invention. Opposite ends of structure 88 are shown terminating with load-transmitting anchor points 90, 92 which, in FIG. 2*b*, are functional analogies to previously-mentioned load-transmitting anchor points 72, 68, respectively. These anchor points, in a building structure employing a roof structure like structure 88, are effectively anchored through the building foundation structure to the ground via stabilizer bar structure, such as that previously discussed herein. The specific make-up (several different modifications) of arched roof structure 88 will be described later herein.

As is true with respect to roof structure 38, associated with roof structure 88 are closure panels which can, as indicated by double-ended curved arrow 94 in FIG. 2*b*, shift with slight relative motion back and forth with respect to neighboring structure.

Figure 6:
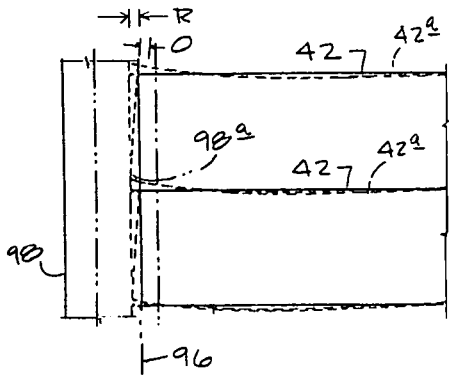
FIG. 6 is a fragmentary, schematic elevation further showing wall beams that are provided in the residence of FIG. 1.

Turning attention back now for a moment to discuss further performance and operational features which characterize the wall beams that make up the walls in residence 30, and focusing particularly on FIG. 6 (third plate of drawings) where two such beams are shown at 42 in a fragmentary vertical stack, in solid lines, these two beams are shown essentially vertically end-aligned, with their left ends in FIG. 6 lying aligned along a gravity line 96. This is a highly idealized situation, but one which will suffice for the explanation which is now to follow. In particular, in FIG. 6, the left ends of beams 42 are received within an accommodating channel space 98*a*, furnished in a vertical corner trim piece 98. Within this corner trim piece, the adjacent ends of beams 42 can shift modestly longitudinally relative to one another along their long axes with a motion range R.

Dashed lines which are pictured in FIG. 6 at 42A show exaggerated deformations that occur in beams 42 when something, for example, a vertical load, causes downward bending of these wall beams to produce slight upwardly facing concavities in the upward surfaces of these beams. The fact that these two beams are permitted to shift relative to one another longitudinally, and also slightly relative to trim piece 98, allows the two beams effectively to operate as independent load-bearing units. A careful look at the disposition of the deformation dashed lines pictured in FIG. 6 will illustrate that, at least as can be seen at the left ends of beams 42 in this figure, the two beams have effectively, at least along their interfacial confrontation region, shifted longitudinally relative to one another, whereby there is now an overlap between the ends of the two beams, shown in FIG. 6 as an angular type of overlap O, also highly exaggerated.

Such bending will normally occur well within the elastic limits of the beams, and so when whatever load which has been applied that produces the deformation thus described in FIG. 6 is removed, the beams will essentially return to the conditions shown for the beams in solid lines in FIG. 6, though not necessarily with the opposite ends of the beams still precisely vertically aligned with one another. In other words, such a deformation, accommodated by independent beam motion relative to adjacent beams also in bending, may from time to time cause the opposite ends of vertically stacked beams to assume relative different vertical dispositions with respect to one another.

The amount of relative motion thus permitted in and promoted by the independent wall beams is an important performance feature of the present invention which uniquely allows these beams to sustain loads in very responsive and fully recoverable manners. The fact, as will become more apparent, that the independent beams are not positively locked to one another, nor locked to any external structure, such as corner trim component 98, but are nevertheless stabilized, constitutes an important structural and operational feature of every building built in accordance with the present invention.

Figure 8:
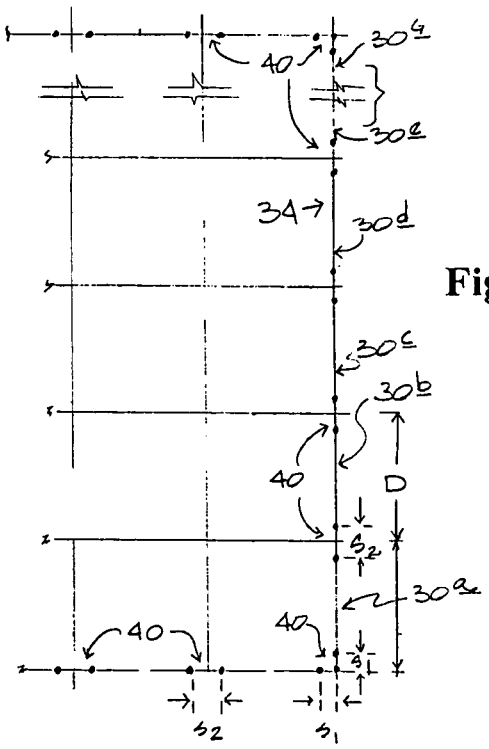
FIG. 8 is a stylized fragmentary plan view illustrating generally one non-gabled side of the residence of FIG. 1.
Figure 7:
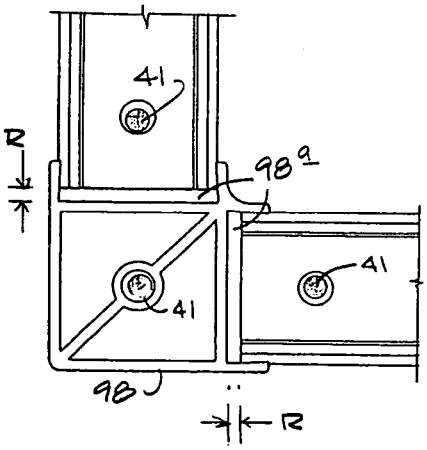
FIG. 7 is a fragmentary plan-illustration-section of a corner of the residence of FIG. 1, showing how corner trim structure, and nearby stabilizer bars, accommodate sliding relative motions between wall beams which are employed in the residence of FIG. 1.
Figure 9:
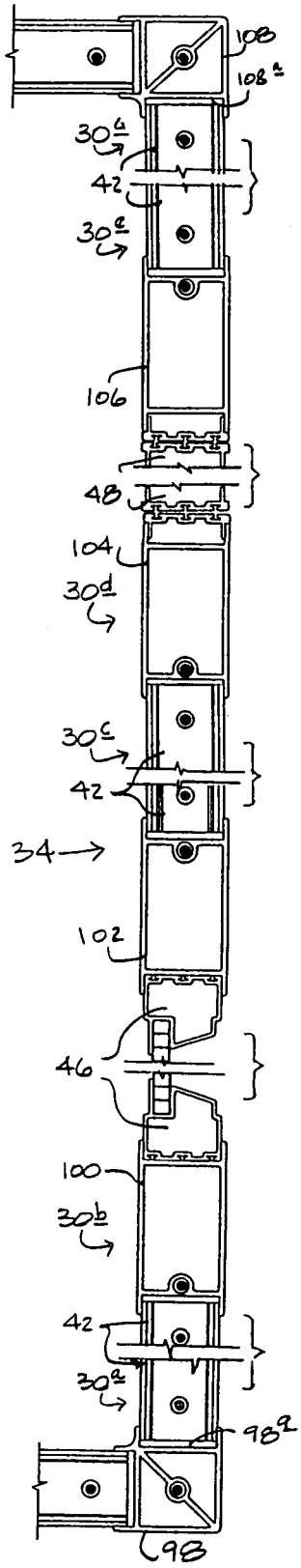
FIG. 9 is a larger-scale, more detailed plan-cross-section view of the same side of the residence pictured in FIG. 8.

Addressing attention now to FIGS. 7, 8 and 9, and looking first of all at FIG. 8, here there is presented in a schematic plan view a more detailed representation of the plan layout of the groups of stabilizer bars numbered 40 and shown very generally in FIGS. 1 and 2. In FIG. 8, several of the groupings of stabilizer bars are thus represented by general reference designators 40, and one will see that there are, fundamentally, two different characteristics of stabilizer bar groupings.

Referring back for a moment to FIG. 1 to describe a little more particularly a visual relationship which is intended to exist between what is shown in FIG. 1 and what is shown in FIG. 8, illustrated in FIG. 1 at 30A, 30B, 30C, 30D, 30E, 30F and 30G are what can be thought of as seven different linearly distributed sections in previously-mentioned wall 34. The layout pictured in FIG. 8 is almost an exact match with respect to these seven wall sections, except that, in FIG. 8, section 30F, which contains a window that can be seen in FIG. 1, has been omitted and fragmented out of FIG. 8. Sections 30A, 30C, 30E and 30G, essentially, are simply entirely made up, from foundation to roof structure, from a vertical stack of elongate, horizontal beams. Sections 30B, 30F (seen only in FIG. 1) include both stacks of horizontally extending beams, and a window. Section 30D includes a certain number of horizontal beams, but principally includes a door previously designated 48. Where regions of adjacent wall sections are uninterrupted by a window or a door, etc., beam structure is essentially unbroken and continuous from section to section. This can be seen especially in FIG. 1 in sections 30A-30C, and 30E-30G.

Referring now very specifically to the organizations of groups of stabilizer bars which are associated with wall 34, there are eight such groupings. All eight are shown generally in FIG. 1. In FIG. 8, however, only six of these groups are pictured—the missing two groups being associated with opposite, lateral sides of fragmented-away wall section 30F. As can be seen in FIG. 8, among these eight group of stabilizer bars, the two corner groups include three stabilizer bars each, and in each other group, there are just two such bars. While different specific lateral spacings within a group of bars can be employed, within a corner group the spacing ($S_1$) between the long axes of next-adjacent bars is about 80-mm, and between bars in each group of two bars, the lateral spacing ($S_2$) between longitudinal axes is about 160-mm. The nominal center-to-center distance (D) between adjacent groups is about 1200-mm.

As will be more fully described shortly, each stabilizer bar is actually made up of a plurality of end-to-end disposed elongate bars which are joined through turnbuckle-like structure which allows for lengthening and shortening of the overall effective upright lengths of the bars. Appropriate threading or similar connection method is provided, as will also become more fully apparent, at locations where threaded connections to the bars are furnished for various purposes. The lower ends of the bars are firmly anchored, as will also shortly be described, through foundation structure 32 and into the underlying ground. The upper ends of the bars are employed with auxiliary structure, still-to-be described, which helps to stabilize the upper regions of the walls, and also to anchor, directly to the foundation, the roof and rafter structure. It should be recalled from a discussion that was presented earlier with respect particularly to FIGS. 2*a*-*b*, that the individual stabilizer bars, in the several groups of bars now distributed around the perimeter of residence 30, form portions of the important banding structures in residence 30.

FIG. 9, which is on a larger scale than that employed in FIG. 8, essentially shows the same plan layout pictured in FIG. 8. Most especially, shown in this figure are actual fragmentary cross sections of specific components that are employed in wall 34, with the exception of wall section 30F which has been fragmented away. Progressing upwardly from the lower portion of FIG. 9 one first encounters: (a) previously-mentioned corner trim component 98; (b) then wall section 30A which is made up entirely of beams 42; (c) wall section 30B which includes a combination of beams 42 and window 46, with lateral sides of this window being defined by trim pieces 100, 102; (d) wall section 30C which is made up substantially entirely of beams 42; (e) wall section 30D which contains principally previously-mentioned door structure 48, opposite lateral sides of the wall structure being defined by trim pieces 104, 106 (which are very much like trim pieces 100, 102); (f) wall section 30E, principally made up of beams 42; (g) wall section 30F (appearing only in FIG. 1) made up of a combination of beams 42 and a window very much like window 46; and (h) wall section 30G which made up principally entirely of beams 42. The upper extremity of wall section 30G in FIG. 9 has its stacked beams' ends stabilized in a channel 108*a* in a corner trim piece 108 which is substantially a duplicate of previously-mentioned trim piece 98.

In FIG. 9, the various trim components mentioned, namely components 98, 100, 102, 104, 106, 108 are formed from extruded plastic material to have the respective cross-sectional appearances clearly illustrated in that figure, and are cut off to have the appropriate lengths to fit appropriately within wall 34. The small circles which one sees distributed essentially along the length of wall 34 in FIG. 9 represent (a) the individual stabilizer bars previously mentioned, and (b) the toleranced clearance holes provided appropriately for them. Details in FIG. 9 of how the bars' circumferences are afforded clearance spaces within the cross sections of the various components through which the bars pass is not specifically shown in FIG. 9, but it should be understood that clearance spaces for the bars are toleranced in order to allow for the earlier-mentioned modest amounts of relative motion between the outside surfaces of the bars and the adjacent structural components in wall structure 34.

FIG. 7, to which attention is now momentarily redirected, more clearly shows this clearance tolerance condition between holes or apertures provided for clearing the outside surfaces of the stabilizer bars.

Turning attention now to FIGS. 10-13, inclusive, foundation structure 32 herein is made up principally of two differently cross-sectioned components including a lower component 32*a* and an upper component 32*b*. Components 32*a*, 32*b* are snapped together to produce collectively what was referred to earlier herein as a flattened V-like cross-sectional configuration.

The region of snapped-together interconnection is shown generally at 32*c*. Components 32*a*, 32*b* are formed in appropriate lengths to which they have been cut in order to form an entire perimeter structure which becomes embedded in the ground as illustrated. These components meet at the corners of residence 30, and are joined there through suitable matching-cross section corner components (not specifically illustrated) which are provided to finish the corner regions. As can be seen quite well in FIG. 13, upper component 32*b* includes a generally horizontal shoulder 32*d* which resides essentially at ground level 66. Rising upwardly from shoulder 32*d* is a male projection portion 32*e* which, as will shortly be explained, receives a complementarily fitting, downwardly directed female portion formed on the underside of a wall beam. These male/female components define the full equivalent, at the foundation level, of the nesting structures which define the snap-together, sliding facial interfaces between vertically stacked, next-adjacent wall beams.

Figures 10, 11, 12, 13, 14, 15:
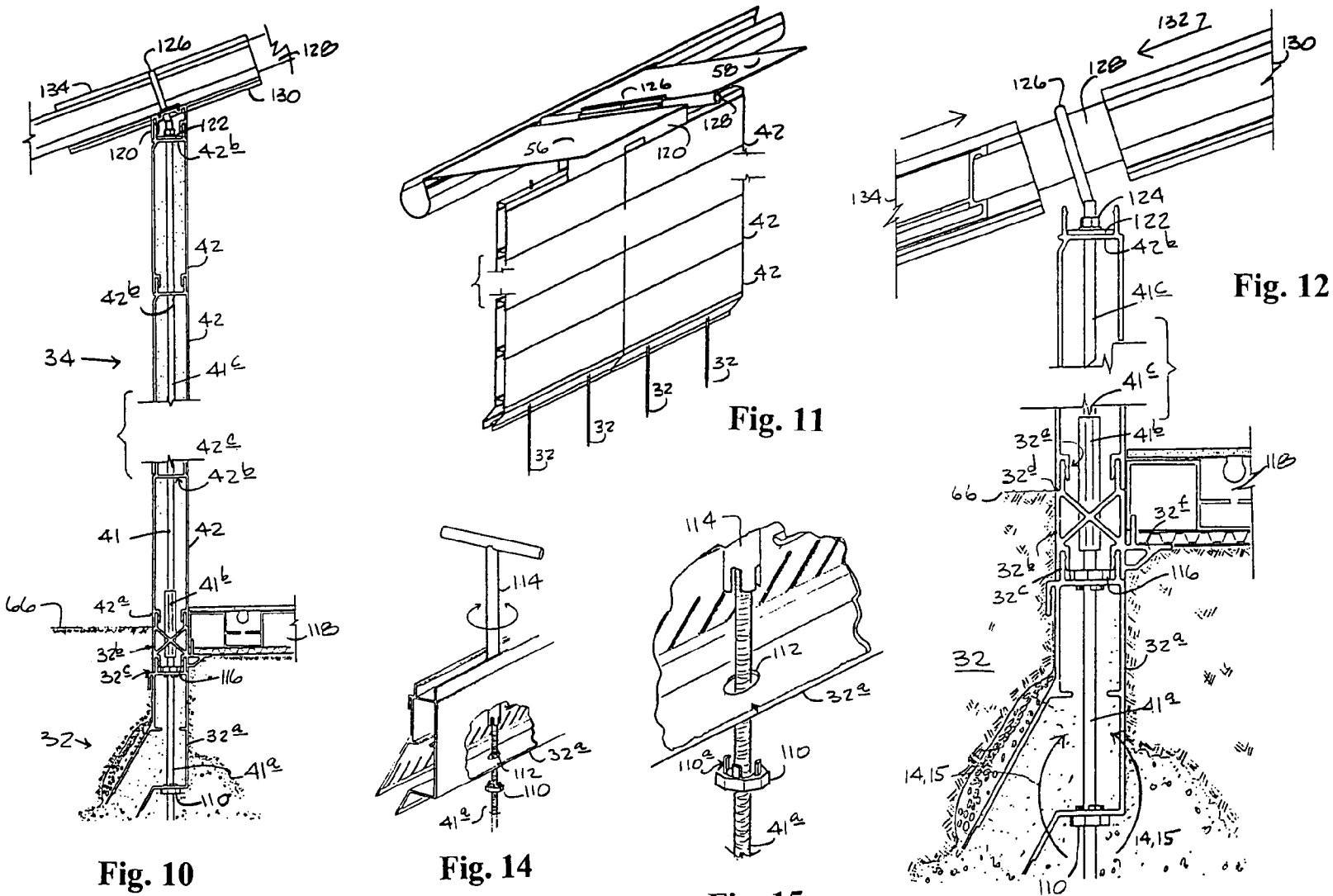
FIG. 10 is a fragmentary, vertical section looking inwardly from the left side of the near, gabled end of the residence of FIG. 1.
FIG. 11 is a smaller-scale, fragmentary, isometric view picturing much the same structure illustrated in FIG. 10.
FIG. 12 is an enlarged, fragmentary detail taken near the upper region of FIG. 10.
FIG. 13 is an enlarged, fragmentary detail taken near the lower region of FIG. 1.
FIGS. 14 and 15, taken along with FIG. 13, illustrate a leveling system which is employed in the residence of FIG. 1. This leveling system (which is actually a perimeter-distributed system) is present, in part, generally in the region in FIG. 13 which is bracketed by the two curved arrows labeled 14, 15-14, 15.

As can be seen in FIGS. 10 and 13, the undivided stabilizer bar pictured here at 41 includes, as illustrated, three components 41*a*, 41*b*, 41*c* which are elongate and longitudinally aligned to form an upstanding structure extending from within the ground below the foundation structure, upwardly to a considerable height above the foundation structure. Suitably provided at the appropriate locations within foundation components 32*a*, 32*b* are clearance bores that afford free vertical passage for the components that make up bar 41. These clearance bases are positioned generally as indicated by the patterns pictured therefor in FIGS. 8 and 9.

Addressing for a moment the stabilizer bars, and the relationships of these bars to the foundation structure, stabilizer bar component 41*a* extends completely through foundation component 32*a*, downwardly therefrom into the ground and upwardly therefrom into the region which enters the lower part of foundation component 32*b*. It is with respect to adjustments shortly to be described that can be performed with respect to stabilizer bar component 41 *a* that a unique leveling operation can be carried out in accordance with the present invention. Continuing, however, specifically with a discussion regarding each stabilizer bar, coupled threadedly to the upper end of bar component 41*a* is a turnbuckle-like sleeve which is component 41*b*. The upper portion of sleeve threadedly receives the lower end of stabilizer bar component 41*c*. Selective rotation, as desired, of sleeve 41*b* effectively shortens or lengthens the overall length of bar 41.

Describing a leveling operation, and how in relation to a leveling operation sleeve 41*b* is adjusted, and turning attention now to FIGS. 14 and 15, threaded onto the upper region of stabilizer bar component 41*a*, and effectively engaging an underside region of foundation component 32*a* as seen, is a specially shaped adjustment nut 110 which has the configuration clearly pictured for it in FIG. 15. Lugs 110*a* which extend upwardly through a suitable accommodating bore 112 provided in foundation component 32*a* center this nut, and therefore, stabilizer bar component 41*a*, with respect to opening 112, with opening 112 affording vertical downward access to nut 110 by a special adjustment tool shown at 114 in FIGS. 14 and 15. The appropriate shape of the lower end of tool 114 is especially well illustrated in FIG. 15, and one will see that, by insertion downwardly of this tool for engagement through opening 112 with nut 110, and by turning of the tool, nut 110 rises upwardly and downwardly on stabilizer bar component 41*a* (which is fixed as an anchor component in the ground) to raise and lower foundation component 32*a*. It is through the use of this mechanism that the entire foundation structure for a building can, on a stabilizer-bar-by-stabilizer-bar basis, be adjusted around the entire perimeter of a building, and in fact wherever a foundation component and a stabilizer bar are present, whether or not at the perimeter of the building structure.

After appropriate leveling of the foundation structure, and knowing in advance what is to be the overall height of the wall expanses that define the building which is being constructed, the appropriate vertical lengths of the stabilizer bars above the foundation is adjusted through operation of turnbuckle components like component 41*b*.

After leveling is performed, the leveled positions of the foundation components around the perimeter of a building are effectively anchored against further adjustment by locking nuts. such as the nut shown at 116 in FIGS. 10 and 13. Nut 116 is essentially the same in construction as previously described nut 110.

Completing a description of what is shown at the lower region of FIG. 10, and in FIG. 13, floor structure employed in residence 30 is shown generally at 118. While the details of this floor structure play no particular role in the structure of the present invention, what should be noted is that, in the particular floor structure illustrated in these two figures, that structure is hooked onto a ledge mounting structure 32*f* which is formed as a part of the extruded cross section of previously described upper foundation member 32*b*.

Thus, what is illustrated in FIGS. 10 and 13 is an arrangement wherein the lower portion of residence 30, and particularly the foundation structure in that residence, is load-bridged not only by the ground which extends between and receives the lower ends of the stabilizer bars, but also by the floor structure which is caught on the floor connection portion 32*f* just mentioned. This bridging condition plays a role in the previously-mentioned banding structure.

Extending upwardly from foundation structure 32 in the particular portion of residence 30 which is illustrated in FIGS. 10, 11 and 13, are plural, vertically-stacked wall beams 42. Each of these beams has a cross-sectional configuration like that which is clearly pictured especially in FIG. 10, and one can see that the lower portion of this cross section is shaped with female nesting structure 42*a* that is snap-caught with respect to male nesting structure 32*e* in foundation component 32*b*. Spanning the top of the cross-sectional configuration of each wall beam is a stretch 42*b* which immediately underlies a male upward projection nesting structure 42*c* which is very much like in construction previously-mentioned male nesting structure 32*e* in foundation component 32*a*. This spanning structure 42*b* is furnished at the appropriate locations with clearance bores such as those that can be seen in FIG. 7 to provide clearance access for stabilizer bars. As was mentioned earlier, and referring back for a moment to FIG. 7, that clearance access is toleranced to allow a certain amount of motion relative to the circumferential outside of the stabilizer bars.

Where windows and doors, etc., are to be included in a building structure, the wall beams at the side regions where these elements are to be put into place are appropriately prepared to length so that the adjacent beam ends will fit within reception channels that are formed in trim pieces that define lateral perimeter structure for windows and doors, etc. With reference back for a moment to FIG. 9, this arrangement can be seen in that figure. Suffice-it-to-say that, adjacent the tops of all of the external walls in residence 30, these walls are vertically completed with an elongate beam from which the roof structure rises, and to which it is attached, as will now be described. While this is true with respect to the structure of residence 30, it should be understood that not in all structures is it necessary that an entire spanning wall beam be present along the upper reaches of a wall structure.

The two, gabled, end walls in residence 30 are formed according to the invention in much the same manner that has just been described so far for wall 34. Appropriate adaptations are, of course, made along the slopes of the gabled structures of these walls.

Shown generally at 120 in FIG. 10, and also in FIG. 11, are finishing trim components which are snapped downwardly into place along the upper reaches of the uppermost wall beams, intermediate the locations of the groups of stabilizer bars. These finishing trim pieces have upper surface angularity, clearly pictured in FIG. 10, which is suitable for the angle designed for the roof structure in residence 30, and the trim pieces are shaped on their undersides essentially to have the same kind of female structure which has been discussed so far in relation to the wall beams. With these upper finishing trim pieces in place, it will be apparent that they fit onto the upper wall beams through sliding interfaces which are very much like those that exist between vertically stacked and adjacent wall beams.

Explaining now with reference to FIGS. 10 and 12 structure which exists specifically at the locations of the upper extremities of the stabilizer bars, resting as shown on spanner reaches 42*b* within the uppermost wall beams are anchoring plates such as plate 122. These plates each have a length, measured normal to the planes of FIGS. 10 and 12 which is sufficient to bridge the two adjacent stabilizer bars in each group of two such bars. Appropriate clearance bores are provided in these plates to receive and slide downwardly over the upper extremities of such two, next-laterally-adjacent bars. At the corners of residence 30, similar plates, not specifically shown, are included which are right-angle plates, and which are configured to receive, clearingly, the upper ends of the three stabilizer bars which form a cluster of bars at those locations.

The upper ends of stabilizer bar components 41*c*, which are the very ends that extend through these anchoring plates, are threaded, and nuts, such as nut 124, are screwed down finger tight onto the stabilizer bar components 41*c* to bear downwardly modestly on anchor plates, like plate 122. This finger-tight connection places a very modest amount of preliminary tension in the stabilizer bars.

Appropriately welded to and rising upwardly from each of the anchoring plates, like plate 122, are reception hoops 126 which are (a) generally circular, (b) angled as shown in FIGS. 10 and 12 to accommodate the angle of the planes of the roof structure, and (c) fitted with a short section of cylindrical metal tubing 128 which extends to opposite sides of what can be thought of as the inclined plane occupied by hoop 126. These tubular components can, of course, have other perimeter configurations, but herein, these configurations are circular.

Thus, essentially all but the roof structure in residence 30 has now been described. And so, turning attention now to FIGS. 16A, 17 and 18, along with FIGS. 10-12, inclusive, one can see that each rafter structure herein essentially takes the form of an elongate extruded component, such as that shown at 130. Each component 130 has an outer end that is slidably fit onto the upwardly directed portion of differed tubular components 128.

Figure 16A:
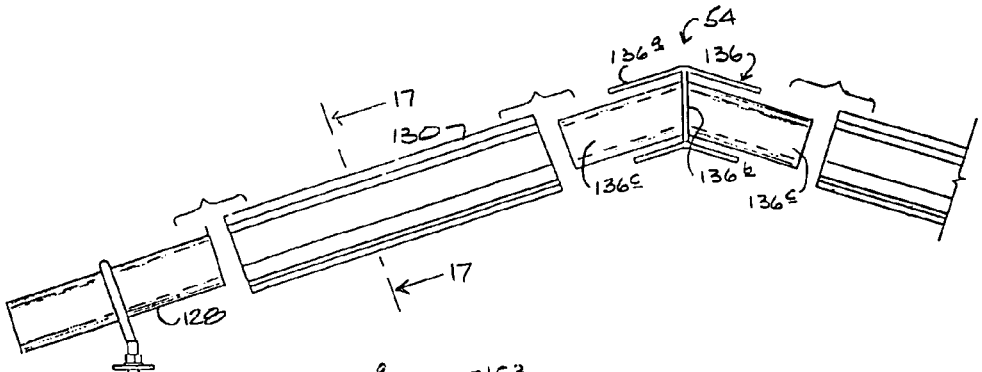
FIGS. 16A and 17 illustrate the configurations of several components that form portions of roof and rafter structure present in the residence of FIG. 1.

In FIG. 16A, components 130, 128 are shown in an exploded and relatively disconnected. set of conditions. In FIG. 12, the components are shown partly assembled, and the downward arrow which appears at 132 in FIG. 12 simply demonstrates the direction of fitting of component 130 onto component 128. In FIG. 10, component 130 is shown fully in position relative to hoop 126.

Shown at 134 in FIGS. 10 and 12 are components which have a cross section that substantially matches that of component 130, and which axially align therewith on and along tubular component 128 to extend laterally outwardly and slightly downwardly from the upper extremities of the wall structures.

Returning to FIG. 16A, and describing what else is shown in this figure, indicated generally at 136 is a ridge structure component which includes angular plate structure 136*a* including a central upright plate 136*b*, and joined to this central plate, two slightly downwardly angled tubular members 136*c*. Members 136*c* have the same cross-sectional cylindrical configuration as earlier-described tubular member 128. In a completed rafter structure, tubular members 136*c* extend into the upper, open ends of structural members 130. In FIG. 16A, the exploded view of this structure, this connection has not yet taken place. When it has taken place, and when the counterpart rafter structure that extends to the right of component 136 in FIG. 16A is also in place, a rigid, bridging rafter structure extends across one region of the roof structure in residence 30 between a pair of stabilizer bars on either side of the residence.

Rafter structures assembled from components like those just discussed with reference to FIGS. 10, 12 and 16A are completed at all appropriate locations along the lengths of the rectangular wall, like wall 34, and with these components in place, what can be thought of as the rafter framework structure of the roof structure is ready to receive closure panels, such as previously-mentioned panels 56, 58, 60, 62.

Figure 17:
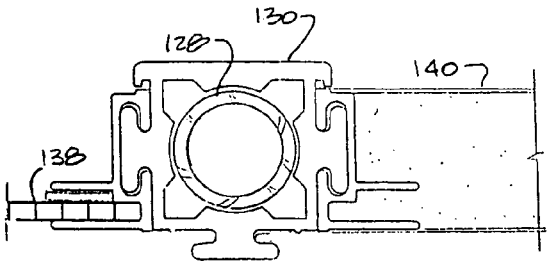

As was mentioned earlier, roof panels like those which have just been mentioned, can take a number of different forms, including panels which are completely light and air opaque, panels which include windows, and other sorts of panels which one can imagine. These panels are appropriately formed with perimeter structure that allows them to be slid into contained positions between adjacent rafter structures that extend downwardly from the ridge in residence 30 toward the lateral wall structures. FIG. 17, which illustrates the cross-sectional configuration of extruded component 130, clearly illustrates how two different kinds of roof panels, shown generally at 138, 140, can be equipped with appropriate extruded perimeter structures to fit slidably onto the opposite lateral sides of rafter component 130. Panel structure 138 herein takes the form of a light-transmissive window structure, and panel 140 takes the form of a light and air opaque closure structure.

Within an overall assembled roof structure like that which has now been generally described, it will be apparent that each panel structure received between a pair of rafter components, like component 130, is permitted a limited amount of relative sliding motion to accommodate various kinds of building load conditions. Further, it will be apparent that vertical downwardly directed loads exerted on the roof structure are carried essentially in compression and bending through the wall beams to the foundation and the ground, and that vertical upwardly directed loads on the roof structure are carried in tension directly through the stabilizer bars to the foundation and to the ground.

Figure 18:
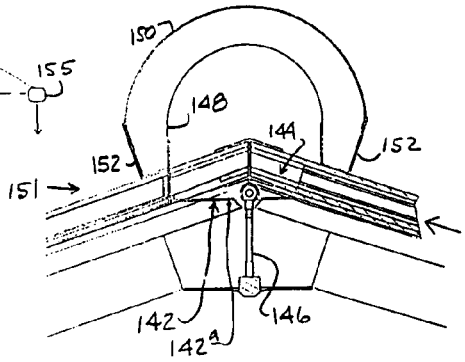
FIG. 18 is a view presenting, on roughly the same exposition level as that which is employed in FIG. 12, details of construction that exist at the roof ridge in the residence of FIG. 1.

FIG. 18 illustrates very generally additional structure which can be employed advantageously to finish off the ridge structure region in residence 30. Here, for example, are included (a) an adjustable vent structure 142 which includes a rockable panel 142*a* which accommodates venting through appropriate air vent spaces furnished, such as the space shown generally at 144, (b) a portion 146 of a fire-suppression plumbing system which is disposed within the residence extending along (in the illustration now being given) the ridge structure, (c) an insect-blocking but air-passing screen structure 148 which is perched as a canopy over the air vent region, and (d) a solid canopy 150 which overrides structure 148 with laterally-opposite edges attached to angle anchor structures such as those shown at 152.

The precise details of construction of these various components just described with respect to FIG. 18 extending along the ridge in residence 30 can be varied in accordance with designer wishes and with respect to different specific building installations. Nonetheless, it is important to note that the structure of the present invention, wherein components are afforded a certain amount of limited relative motion, uniquely furnishes the opportunity for affording vent spacing near the ridge structure in a building. The structure also uniquely allows for the easy installation of an internal fire-suppression system, and readily accommodates the attachment and use of canopy structures like those designated 148, 150 in FIG. 18. Not specifically shown in FIG. 18, although present in residence 30 are protrusions that are appropriately formed on the upper edges of panel structures that are received in the rafter structure, which protrusions become caught so as effectively to lock the panels against downward escape from between the rafter structures.

Figure 16B:
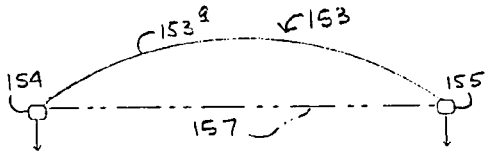
FIG. 16B is a simplified schematic drawing which illustrates two different types of arched roof structures made up of components quite similar to those shown in FIGS. 16A, 17.

With attention now directed to FIG. 16B, indicated generally at 153 is one form of an arched roof structure proposed according to the present invention. In this schematic diagram, and with respect to the description of it which is now being given, structure 153 includes plural elongate arched rafter structures, such as that represented at 153*a* by a single curved line. This rafter structure is essentially constructed from the same kinds of components, such as components 126, 128, 130, previously discussed, wherein the component which is a counterpart of previously-mentioned component 130 is one elongate, unbroken element which has no angularity or ridge structure, and which extends across a span in a building, such as residence 30, between the pair of spaced walls, such as between the two rectangular walls present in residence 30. The opposite ends of rafter structure 153*a* are supported through compression attachment components 154, 155 that reside at the upper extremities of walls at the locations shown, for example, in FIGS. 10 and 12, where retainer hoop 126 is shown.

In an overall roof structure constructed in accordance with the description now being given utilizing FIG. 16B, plural rafter structures, like structure 153*a*, are distributed in the manner generally described earlier for rafter structures 50, 52.

Closure panels are slidably received at the edges of the components in the rafter structures, and form an appropriate matching arch simply by bending as they are introduced slidably into and along the receiving structures in the rafter components.

FIG. 16B can also be employed, and is now so employed, to describe still another form of arched roof and rafter structure suitable for incorporation, for example, in a building such as residence 30. Here, what distinguishes this form of roof and rafter structure from that which has just been described is that, instead of attaching components 154, 155 acting as compression attachment components for the opposite ends of a rafter structure, each elongate rafter structure is held in the appropriate arched configuration by an elongate tensed spanner line, such as that shown by dash-double-dot line 157 in FIG. 16B.

Figure 19:
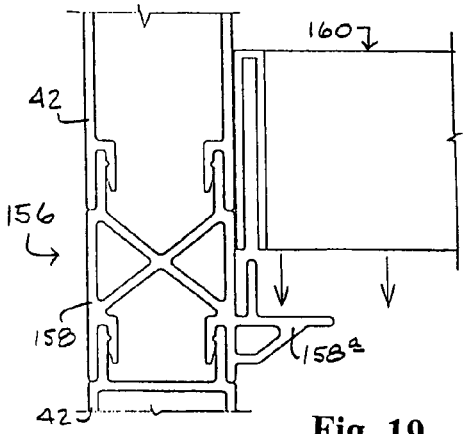
FIG. 19 is a fragmentary, cross-sectional elevation illustrating a portion of a building, somewhat like the residence of FIG. 1, which has two stories.

Turning attention now to FIG. 19, here there is shown fragmentarily at 156 a modified form of single wall structure which has been designed to accommodate a two-level building structure. Effectively what is shown in FIG. 19 that accomplishes this, is the presence of a component 158 which is essentially the same in construction as previously-mentioned upper foundation component 32*b* illustrated in FIGS. 10 and 13. Component 158 is snap-fitted at the appropriate height onto the upper male nesting portion of a wall beam which in FIG. 19 is also given reference numeral 42. Snap-fit onto the upper male nesting portion of component 158 in FIG. 19 is the lower female nesting portion of an overhead wall beam, also designated 42. The inward-turned ledge portion 158*a* in component 158, which is like previously-mentioned portion 32*f* in foundation component 32*b*, is positioned to receive downwardly placed floor structure shown generally at 160 in FIG. 19.

Figure 20:
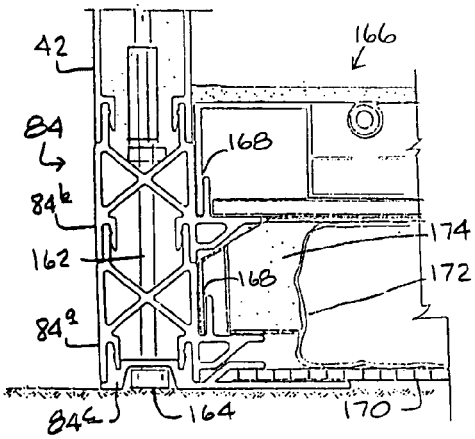
FIG. 20 is a fragmentary, cross-sectional detail of an above-ground foundation made in accordance with the present invention.

FIG. 20 illustrates in a more detailed fashion previously-mentioned alternative foundation structure 84 which was first mentioned with respect to earlier-discussed FIGS. 2*a-b* herein. Foundation structure 84 as here pictured includes three components 84*a*, 84*b* , 84*c* which are snap-fitted nestingly in vertical disposition relative to one another. Components 84*a*, 84*b* are the same in construction and are effectively the same in cross-sectional configuration as previously-described components 32*b* and 158. Component 84*c* forms a base component in foundation structure 84 and has a cross-sectional configuration which for it is also clearly pictured in FIG. 20. Component 84*c* like components 84*a*, 84*b* is extruded from plastic material, such as PVC material.

Rising upwardly from upper foundation component 84*b* is a wall beam 42 which is snap-fitted onto this component in the manner previously described for beams 42 in residence 30.

With respect to foundation structure 84, which structure does not penetrate the ground, stabilizer bars, such as the bar shown at 162, extends downwardly through components 84*a*, 84*b*, and is secured against vertical retraction by a nut 164 which is essentially the same in construction as previously-described nut 110.

Floor and other lower structure in a building employing foundation structure 84 is generally pointed to at 166 in FIG. 20, but details of this floor structure do not form part of the present invention. What should be mentioned however, is that lateral load-bearing between spaced components in foundation structure 84 is borne through floor components which latch onto the foundation components such as is illustrated generally at 168 in FIG. 20.

Further describing what is shown in FIG. 20, appropriately bonded to foundation component 84, and to the other like components which are distributed around the perimeter of a building employing foundation structure 84, is a base expanse 170. Disposed above base expanse 170, and directly resting on this expanse, according to what is pictured in FIG. 20, is a large water bladder 172 which can perform a number of functions in a building employing foundation structure 84. These functions include introducing substantial weight adjacent the base of a building to stabilize the overall structure with respect to its position on the ground.

Transversely spanning spaced locations in foundation structure 84 are plural beams, such as the beam shown generally at 174 in FIG. 20. These transverse beams play a role in laterally stabilizing the relative positions of spaced portions of foundation structure 84.

Given all of this structure closely associated with a foundation structure like structure 84, it is clear that a building constructed employing this foundation structure is furnished with substantial positional stability relative to the undersupporting ground surface.

Figure 21:
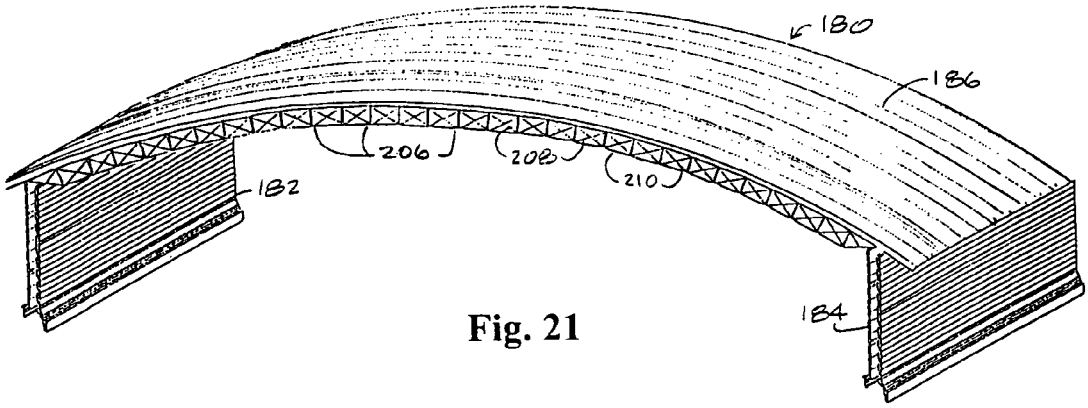
FIG. 21 is a simplified, fragmentary, isometric view showing a large double-outside-walled building structure, including a broad arched roof structure, built in accordance with the present invention.
Figure 22:
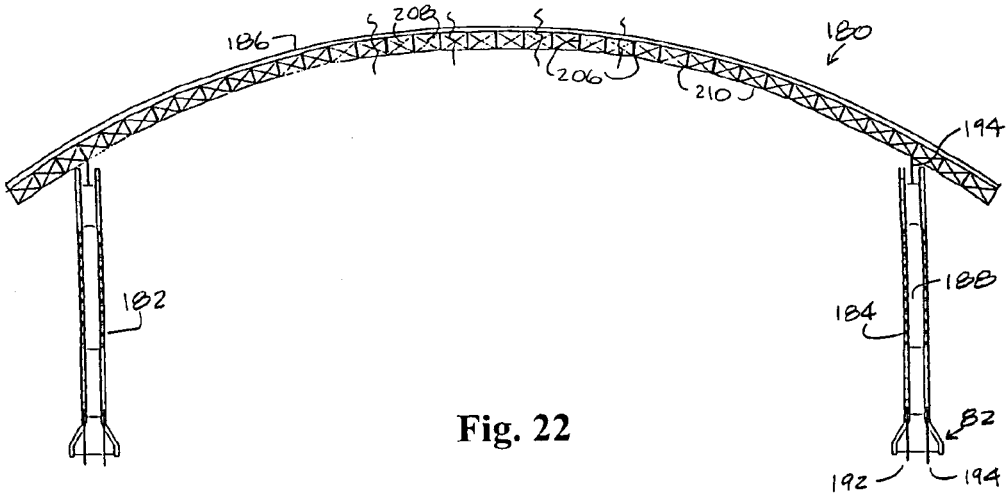
FIGS. 22-25, inclusive, (appearing on two plates of drawings) present various different views of components that make up the arched roof structure pictured in FIG. 21.

Turning attention now to FIGS. 21-27, inclusive, in FIGS. 21, 22 there is shown generally at 180 a broad-expanse, large building structure which is formed with what were referred to herein earlier as double-exterior-wall structures, such as the two shown at 182, 184. Wall structures 182, 184 are spanned by an overhead curved/arched roof structure 186. Focusing attention especially for a moment on FIGS. 22, 26 and 27, and discussing wall structures 182, 184 with specific reference to wall structure 184, here one can see that this wall structure includes inner and outer portions 184*a*, 184*b*, respectively, each of which has much the same individual construction as previously described wall structure 34. Because of this similarity, no further detailed description of wall structure 184 is given herein. With respect to these inner and outer wall portions, the space between them is substantially filled in the building now being described with concrete 188. The foundation structure provided for wall structures 182, 184 is specifically shown schematically at 82 in FIGS. 2*a*-*b*, and can be seen to have great similarity to previously-described foundation structure 32. This foundation structure has a somewhat flattened Z-shaped configuration on its opposite sides, with this configuration essentially resulting from the vertical, somewhat reverse-mirror-image combination of two extruded components like previously-described foundation component 32*a* in FIG. 10. Elongate stabilizer bars in appropriate clusters of bars are provided for the wall structures in building 180, and two bars included in this arrangement of stabilizer bars are shown at 190,192 in FIGS. 22, 26 and 27.

Figure 26:
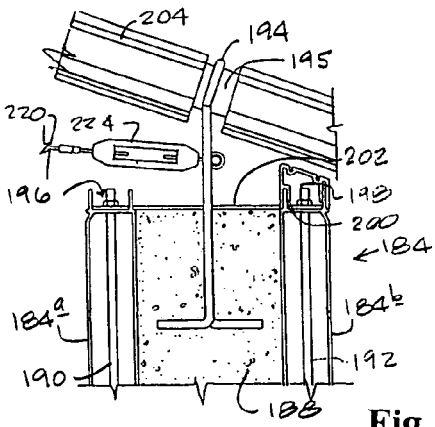
FIG. 26 is a fragmentary detail illustrating how the roof structure of FIG. 21 is anchored near the top of exterior wall structure.
Figure 27:
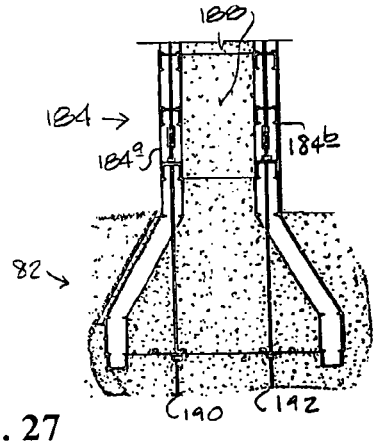
FIG. 27 is a fragmentary detail illustrating an above-ground foundation structure which is employed in the building of FIG. 1.

Focusing attention for a moment briefly on FIG. 26, embedded in the upper reaches of concrete formation 188 in wall structure 184 is a hoop-like rafter structure component 194 which, except with respect to its configuration which is embedded in concrete, is very much like previously described component 126 seen in FIGS. 10 and 12. As will be explained, this component is adapted to receive portions of the now-to-be-described arched roof structure 186 which bridges between wall structures 182, 184 in building 180. A further matter to note with respect to what is shown in FIG. 26 is the presence at locations 196, 198 of securing structure which is provided adjacent the upper ends of stabilizer bars 190, 192, respectively. An upper tie plate 202 bridges between connection locations 196, 198 as seen in FIG. 26. Also to be noted in FIG. 26, is the presence in the region of securing structure 198 of a trim finishing component 200 which is very much like previously-described trim component 120.

Figure 23:
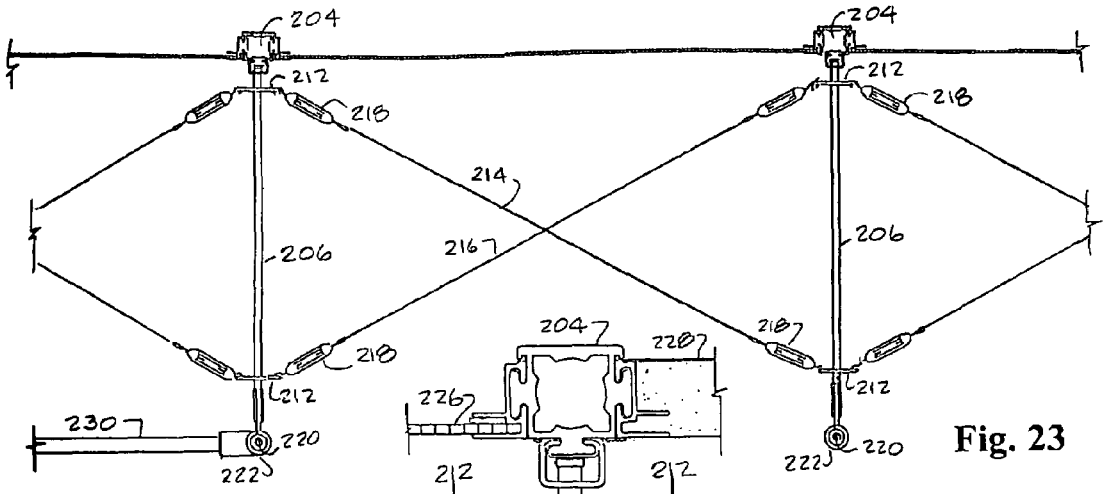
Figure 24:
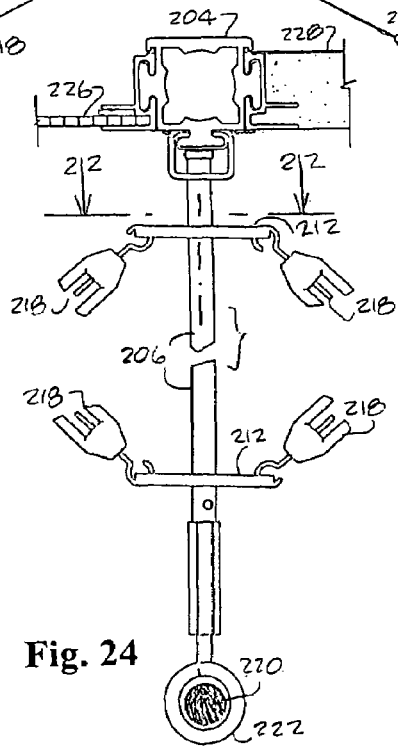
Figure 25:
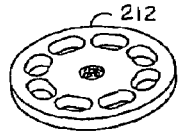

Turning attention now especially to FIGS. 23-25, inclusive, within the group of figures which generally picture building structure 180, extending in arched conditions between wall structures 182, 184 are elongate rafter components 204 which have substantially the same extruded cross-sectional configuration previously-described for rafter component 130. Each of these elongate components has its opposite ends receiving the inwardly projecting tubular components such as component 195 pictured in FIG. 26.

Mounted on and distributed at spaced locations along the underside of each component 204 are plural downwardly extending struts, and appropriate attaching structure, such as that shown generally at 206 in the figures. The specific mounting arrangements provided for these struts is most clearly shown in FIGS. 23 and 24.

Extending and tensed appropriately between next adjacent struts 206 distributed along a given structure 204 is a crossing arrangement of tensed cables, such as those shown at 208, 210 in FIGS. 21 and 22. Between each two adjacent struts along the length of a component 204, cables 208, 210 lie substantially in a common plane which is the plane of FIG. 22 in the drawings. Opposite ends of these cables are anchored to the struts through attachment rings, such as the rings shown at 212 in FIGS. 23, 24 and 25. Cables 208, 210 are only pictured herein in FIGS. 21 and 22, but companion cables which play a role orthogonally with respect to cables 208, 210 are shown especially in FIGS. 23 and 24 at 214, 216. Cables 214, 216 lie in a common plane which, as was just mentioned, is substantially normal to the plane of FIG. 22. These two cables extend between next adjacent struts that lie in this orthogonal plane, and extend between adjacent struts that project downwardly from adjacent elongate curved rafter components, such as component 204.

As can be seen in FIGS. 23 and 24 the opposite ends of all of these just-mentioned cables are attached through spaced rings 212 located as shown near the opposite ends of struts 206 via turnbuckle structures such as the structures shown at 218 in FIGS. 23 and 24. Appropriate tensioning of cables 208, 210, 214, 216 establishes the appropriate angular and spaced relationships between the downwardly-extending struts, and ultimately, provides appropriate cable-lock interconnections between elongate elements 204.

Further included in the cable truss structure now being described, and associated individually with each of elongate structures 204 and the downwardly-extending struts attached to that structure, are elongate spanner cables such as the ones shown in cross section at 220 in FIGS. 23 and 24. Each cable 220 extends through appropriately accommodating eyelets, such as those shown at 222 near the lower extremities of struts 206, and each such cable generally follows about the same arched curvature that is pictured in FIGS. 21 and 22 for roof structure 186. With one set of ends of these cables appropriately initially anchored (see especially FIG. 26) through turnbuckle structure like that shown at 224 in FIG. 26, to the downwardly-extending portion below a hoop structure 194, the other end is tensed adjacent its opposite end to draw the entire roof structure into the appropriate arch for fitment between wall structures 182, 184. It should be pointed out that a manner of accomplishing this includes basically securing one side of the overall roof structure in a generally flattened condition to the upper reaches of one wall structure, followed by the tensing of the spanner cables, like cable 220, to draw the entire structure into the appropriate just-mentioned arch. Any adjustments that are then necessary to ensure appropriate positioning of all of the downwardly-extending struts. and the cross-connecting cables between these struts, is then performed as a final stage in properly stabilizing and configuring the arched roof structure of this invention.

At the arched-wall opposite ends of a building like building 180, horizontal tension struts, like strut 230 shown in FIG. 23, provide lateral stabilization to the various elongate rims of crossed cables which lie in planes in building 180 like the plane of FIG. 23.

It will be apparent that a cable truss structure, with spanner tension cables, as proposed herein offers a unique kind of arching roof structure which is capable of spanning broad distances between spaced wall structures, with a great deal of adjustment versatility permitted because of the rich presence of adjustability through turnbuckle-like structures, of all of the configuration forming and defining tension cables.

Figure 28:
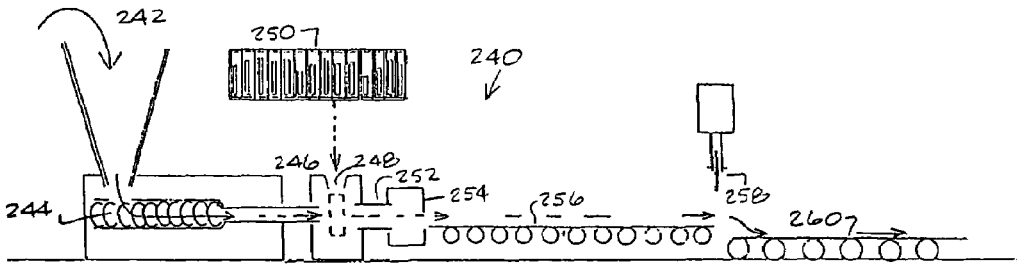
FIG. 28 is a block/schematic diagram illustrating on-job-site extrusion of plastic building components in accordance with one manner of practicing the methodology of the present invention.

Addressing attention now to FIG. 28 in the drawings, here, illustrated generally at 240 is an organization of production equipment which has been set up on a job site, such as the job site associated with residence 30, to create, on that site, and as needed, all of the actual, extruded, plastic building components required for the complete fabrication of the residence.

Included in this equipment is a hopper infeed shown at 242 into which raw source plastic PVC material, typically in pelletized form, is introduced, and fed from this hopper into a single- or plural-auger extruder 244. The hopper and extruder are entirely conventional in construction, and are set up in such a fashion that augured, heated, soft extruded PVC material exits the auger part of the system at 246. From the auger equipment, that material enters a die structure 248 which includes, at the operator's selection, one of many appropriately available, selected, building-component extrusion dies drawn from an appropriate library or collection of dies 250. The dies in this collection are, of course, especially designed to create components having all of the desired building cross sections, such as those which have been discussed and illustrated herein.

From die structure 248, shaped, hot, extruded material with the proper cross section exits at 252, and enters an appropriate, conventional cooling chamber structure 254, wherein the extruded cross-sectioned component material is cooled and stabilized into the desired final cross-sectional configuration.

From chamber 254, cooled, extruded building-component material is delivered along a conveyor 256 appropriately to a cross-cutting machine shown generally at 258 which is downstream from chamber 254. By operation of the cross-cutting machine, appropriate predetermined lengths of the differently cross-sectioned on-site building components are properly trimmed to length, and discharged on a discharge conveyor shown generally at 260. From conveyor 260, these finished components are either stockpiled for use as needed, or otherwise removed for employment in a building project. Completed components are thus readied as needed on the job site for rapid and efficient assembly of a building structure.

Clearly this unique opportunity which is afforded by this invention for creation on the spot of the necessary building components is not only a very efficient and effective way of managing the building of a structure, but is also an approach which allows for great "forgiveness" in the event that a component intended for assembly becomes damaged, or in some other way compromised. Such a component is quickly and easily replaced. Further, with respect to the principal, extruded building components, in all structures contemplated for building in accordance with this invention, the delivery of building materials to a job site, utilizing an arrangement such as that generally pictured in FIG. 28, greatly simplifies and makes more economical the delivery to a site of "building materials".

It should now be apparent that a novel modular building system, and significant related methodology, are proposed according to the present invention, and have been illustrated and described herein. Certain modifications and variations have also been discussed and illustrated. Buildings fabricated pursuant to the invention are extremely easily and quickly assemblable, are producible in a wide variety of styles, sizes and functionalities, and are remarkably able to manage expectable building loads with confidence and high reliability.

High skill levels and exotic, numerous tools are not required for building construction, and the fact that extruded components having multiple functionalities are contemplated leads to highly economic building projects which can create structures that are very affordable. Minimization of tools requirements is clearly evidenced by the fact that most joinders are accomplished by snap and slide inter-engagement between components. Ingenuity displayed in the designs contemplated for foundation structure offers a building approach which can easily be employed in a wide variety of ground terrains and conditions.

While the invention has been disclosed in a particular setting, and in particular forms herein, the specific embodiments disclosed, illustrated and described herein are not to be considered in a limiting sense. Numerous variations, some of which have been discussed, are possible. Applicant regards the subject matter of their invention to include all novel and non-obvious combinations and subcombinations of the various elements, features, functions and/or properties disclosed herein. No single feature, function, element or property of the disclosed embodiments is essential. The following claims define certain combinations and subcombinations which are regarded as useful, novel and non-obvious. Other such combinations and subcombinations of features, functions, elements and/or properties may be claimed through amendment of the present claims or through presentation of new claims in this or in a related application. Such amended and/or new claims, whether they are broader, narrower or equal in scope to the originally presented claims, are also regarded as included within the subject matter of applicant's invention.

I claim:

1. A building structure comprising plural banding structures each banding structure including first and second stabilizing bars vertically positioned in opposing parallel wall expanses, the first and second stabilizing bars being structurally connected via one or more roof rafters, each roof rafter having opposing lateral sides, each lateral side having a first connection mechanism;

each one of the wall expanses including plural, elongate, vertically stacked plastic beam elements cooperatively assembled to permit sliding longitudinal motion relative to each other when vertically stacked, wherein said elements include apertures defining a common channel that runs vertically through the wall expanse;

each stabilizer bar being positioned in one of the channels, the bar having a circumference small enough to create tolerance space within the apertures in a direction coplanar with the wall expanse to allow said beam elements a predetermined range of longitudinal movement relative to each other after said wall structure is finally constructed; and one or more elongate, plastic roof panels, each panel having a long axis and side portions configured for sliding engagement with a connection mechanism of the one or more roof rafters, the connection mechanism permitting sliding of the roof panel relative to the roof rafter in a direction parallel to the long axis of the roof panel.

2. The wall structure of claim 1; wherein said beam elements include upper and lower portions, the upper portion having a male nesting structure, the lower portion having a corresponding female nesting structure, wherein the male and female nesting structures create a vertically nested condition between vertically, next-adjacent elements, said nesting structures inhibiting lateral separation between the next-adjacent elements in a direction which is generally normal to the plane of each one of the wall expanses, but allowing longitudinal motion between the next-adjacent elements.

3. The wall structure of claims 1 or 2, wherein said elements have spaced, oppositely outwardly facing, generally planar surfaces each of which is substantially parallel to the plane of each one of the wall expanses, and said stabilizer bar is positioned between said surfaces.

4. The wall structure of claim 3, wherein pairs of vertically next-adjacent elements include co-contacting slide surfaces, and said stabilizer bar is operatively connected to said elements in a manner cooperating with said slide surfaces to permit individual load-bending of each element in the plane of each one of the wall expanses.

5. The wall structure of claims 1 or 2, wherein pairs of vertically next-adjacent elements include co-contacting slide surfaces, and said stabilizer bar is operatively connected to said elements in a manner cooperating with said slide surfaces to permit individual load-bending of each element in the plane of each one of the wall expanses.

6. The wall structure of claim 1, wherein said elements include upper and lower portions, the upper portion having a female nesting structure, the lower portion having a corresponding male nesting structure, wherein the male and female nesting structures create a vertically nested condition between vertically, next-adjacent elements, said nesting structures inhibiting lateral separation between the next-adjacent elements in a direction which is generally normal to the plane of each one of the wall expanses, but allowing longitudinal motion between the next-adjacent elements.

7. The building structure of claim 1, wherein the first connection mechanism of the roof rafter is a male connection mechanism and the side portions of the one or more roof panels define a complementary female connection mechanism.

8. The building structure of claim 1, wherein the one or more roof panels are light and air opaque.

9. Building structure anchored to a ground, comprising first and second opposing upright wall structures, each one of the wall structures having (a) a lower extremity effectively seated on a foundation on said ground, and (b) an upper extremity disposed above said foundation, and formed from plural, elongate, vertically stacked, generally horizontal plastic beams, wherein said beams include apertures defining a common channel that runs from generally adjacent the bottom to generally adjacent the top of the stack;

each one of the wall structures having at least one upright, elongate, slender stabilizer bar having a lower end extending through the foundation and anchored to said ground, and an upper end extending through the foundation and positioned within the channel, the bar having a circumference small enough to create tolerance space within the apertures in a direction coplanar with the wall structure to permit said beams to move longitudinally relative to each other after said bar is positioned within the channel and after said building structure is finally constructed; and one or more roof rafters connecting upper end portions of the stabilizer bar in the first and second wall structures, each roof rafter having opposing lateral sides, each lateral side having a first connection mechanism; and one or more elongate, plastic roof panels, each panel having a long axis and side portions configured for sliding engagement with a connection mechanism of the one or more roof rafters, the connection mechanism permitting sliding of the roof panel relative to the roof rafter in a direction parallel to the long axis of the roof panel.

10. The building structure of claim 9, wherein the upper end of said bar extends within the common channel in said wall structure to the upper extremity of each one of said wall structures.

11. The building structure of claims 9 or 10, wherein next-adjacent beams in each one of said wall structures are vertically juxtaposed in longitudinal sliding contact with one another.

12. The building structure of claim 11, wherein vertically next-adjacent beams engage one another through nested tongue and groove substructures, with the lower beam in a vertically engaged pair of beams having upwardly extending tongue substructure, and the upper beam in that pair having downwardly facing groove substructure.

13. The building structure of claims 9 or 10, wherein vertically next-adjacent beams engage one another through nested tongue and groove substructures, with the lower beam in a vertically engaged pair of beams having upwardly extending tongue substructure, and the upper beam in that pair having downwardly facing groove substructure.

14. The building structure of claim 10, further comprising roof structure disposed above each one of said wall structures and anchored to said ground through said bars.

15. The building structure of claim 14, wherein the roof structure is formed of plural, side-by-side panel members generally distributed along the lengths of said wall structure, and mounted in the building structure for preferential relative motion, after the building structure is constructed.

16. The building structure of claim 14, wherein each one of said wall structures includes a pair of spaced, generally planar and parallel wall sections, and said roof structure possesses an upwardly arched configuration that extends as a curved expanse between said wall sections.

17. The building structure of claim 16, wherein said roof structure is formed with plural, arched, elongate rafter structures that extend between said wall sections, and the arched configurations of said rafter structures are established by tensed, cross-element truss structures, and by elongate, tensed spanner cables which are operatively associated with said truss structures, and which also extend between said wall sections.

* * * * *